United States Patent [19]

DeLuca

[11] 4,286,489

[45] Sep. 1, 1981

[54] SHEET MATERIAL DISPENSER HANDWHEEL AND CUTTING KNIFE

[75] Inventor: Raymond F. DeLuca, Stamford, Conn.

[73] Assignee: Georgia-Pacific Corporation, Portland, Oreg.

[21] Appl. No.: 136,273

[22] Filed: Apr. 1, 1980

[51] Int. Cl.[3] ..... A47K 10/36

[52] U.S. Cl. ..... 83/335; 83/314; 83/564; 83/649

[58] Field of Search ..... 83/314, 334, 335, 337, 83/564, 649

[56] References Cited

U.S. PATENT DOCUMENTS

| | | | |
|---|---|---|---|
| Re. 28,911 | 7/1976 | Jespersen et al. | 83/334 X |
| 3,896,691 | 7/1975 | Granger | 83/335 |
| 4,137,805 | 2/1979 | DeLuca | 83/649 X |
| 4,188,844 | 2/1980 | DeLuca | 83/335 X |

*Primary Examiner*—J. M. Meister

*Attorney, Agent, or Firm*—Schuyler, Banner, Birch, McKie & Beckett

[57] ABSTRACT

A dispenser guides a web from a roll of sheet material over a feed roller to a position to be grasped by the user while roller mounted knife means cuts the web into individual sheets and a manually engagable handwheel, rotatable with the feed roller, provides peripherally spaced finger notches to facilitate manual forward rotation of the roller in dispensing the material. The notches are formed differently in separate circumferential portions of the handwheel such that pawl means, successively engaging the notches incident handwheel rotation, prevents reverse rotation of the feed roller throughout a first portion of each feed roller revolution and biasing means acts to cause reverse rotation throughout a second portion of the feed roller revolution to assure return of the knife means to a safe inaccessible location within the dispenser when the handwheel is released.

7 Claims, 3 Drawing Figures

10
12
14
16
18
20
22
24
26
28
30
32
34
36
38
40
42
44
50
52
54
56
60
62
64
C
R
W

SHEET MATERIAL DISPENSER HANDWHEEL AND CUTTING KNIFE

BACKGROUND OF THE INVENTION

The field of the invention involves dispensers for sheet material. Specifically, the invention relates to a wall mountable dispenser for rolls of flexible sheet material, such as rolls of paper toweling. Particularly, this invention relates to these dispensers wherein a cutter mechanism is associated with a feed roller used in guiding a web from the roll of material out of the dispenser.

Dispensers for flexible sheet material, such as paper toweling, have long been known which include mechanisms for perforating or severing a web of such material to divide it into individual sheets that are provided by the dispenser to the user. Frequently, the perforating or severing mechanisms used in these dispensers include a rotatably mounted knife and a corporating rotatably mounted roller having a slot therein for receiving the radially outward cutting edge of the knife as the knife rotates past this roller. The web of flexible sheet material is passed between the roller and the knife to be perforated or severed when the radially outward knife portion enters the slot in the roller.

Cutter mechanisms for sheet material dispensers are also known in the prior art wherein a feed roller has mounted therewithin a cutting knife which is cammed outwardly of the roller periphery to sever a web of sheet material coming from a roll of such material.

Characteristic of most prior art sheet material dispensers is the feature of guiding a web of material from a roll to a position outside of the dispenser were it is to be grasped by the user for removal from the dispenser. To insure reliable continued availability of the sheet material to the user, these prior art dispensers are frequently provided with a manually engagable handwheel that is accessible to the user exteriorally of the dispenser housing. To insure against inadvertent reverse rotation of the handwheel by the user, the prior art has proposed inclusion of mechanisms within the dispenser to prevent this reverse rotation which, if it occurred, could result in the web of material from the roll becoming disengaged from the feeding mechanism within the dispenser and thus prevent further effective dispensing of sheet material to subsequent users.

Obviously when the roll or rolls of sheet material mounted within the dispenser for dispensing to the user are exhausted, the dispenser must be reloaded with fresh sheet material rolls. Generally, this involves removing or opening a housing cover for insertion of the fresh sheet material rolls. In this open condition of the dispenser, the attendant involved in reloading the dispenser can be exposed to the cutter mechanism that is provided within the dispenser to perform dividing the web of material into individual sheets that are thereupon supplied to the user. Such exposure is particularly true in connection with roll material reloading where the initial web length must be threaded through the dispenser to a point where it can be grasped by the user. Generally, this threading operation will involve passing the web of material over the feed roller which is associated with the cutting knife of the cutter mechanism. Thus, the attendant loading the dispenser becomes exposed to the knife cutting edge and possible consequent injury to the attendant's hands or arms incident threading the web of material from the fresh roll to a point where its end is exposed for dispensing outside of the dispenser.

With the foregoing in mind, it is an important object of the present invention to provide a flexible sheet material dispenser with a cutter mechanism having a manually engagable handwheel accessible to the user exteriorally of the dispenser wherein the cutter mechanism is moved to a protected location within the dispenser when the handwheel is released for added safety in connection with the operation of reloading the dispenser with fresh rolls of sheet material.

It is also an object of the invention to provide a dispenser having a cutting mechanism for rolled sheet material with a specifically formed manually engagable handwheel cooperating with an anti-reversing device which functions to permit return of the cutting mechanism to a protected location by the action of biasing means that urges certain movements of such handwheel.

It is a further object of the invention to provide a flexible sheet material dispenser having a cutting mechanism associated with a feed roller that is provided with a manually engagable handwheel wherein anti-reversing means and biasing means cooperate to return the cutting mechanism to a protected location within the dispenser when the handwheel is free from manual restraint.

An additional object of the invention is to provide a flexible sheet material dispenser having a handwheel wherein the handwheel periphery is provided with finger engagable notches of differing configurations in separate circumferential portions thereof such that the combined operation of anti-reversing means and biasing means assures cutter mechanism movement to a protected location within the dispenser when the handwheel is in a released state.

These and other object of the invention will become apparent upon consideration of the detailed description of a preferred embodiment of the invention given in connection with the following drawings.

DESCRIPTION OF A PREFERRED EMBODIMENT

Figures 1, 2, 3:
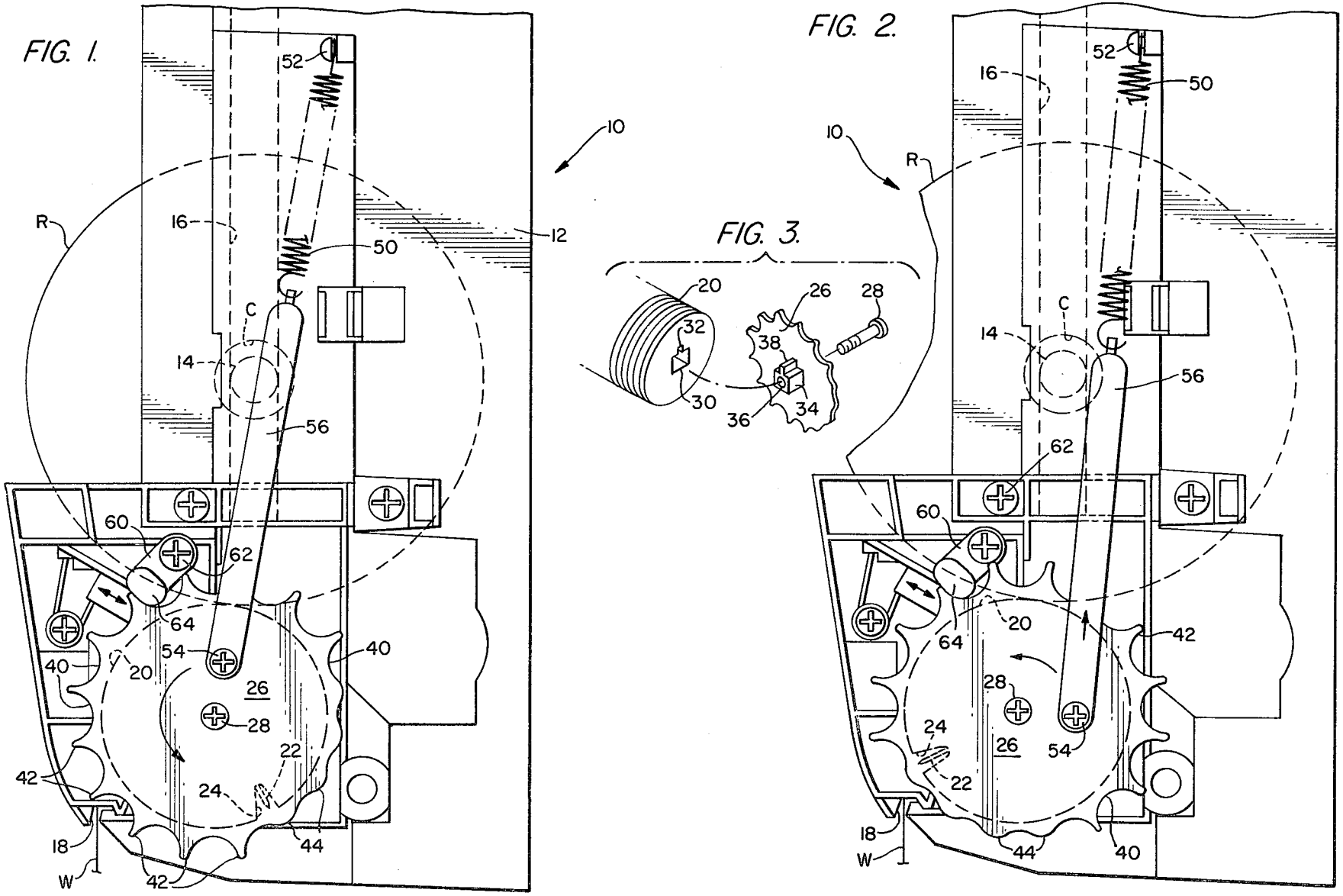
FIG. 1 is a partial end elevational view showing the invention embodied in a sheet material dispenser with the dispenser cover removed.
FIG. 2 is a view similar to FIG. 1 showing certain of the dispenser components in a different operational position.
FIG. 3 is an exploded view showing a manner in which a handwheel and feed roller are keyed together in a predetermined oriented relation.

A dispenser 10 of appropriate construction for rolled sheet material of and embodying the invention is shown, in its pertinent parts, in FIGS. 1 and 2 on the drawing. Both of these drawing figures illustrate the basic parts of the dispenser 10 with certain components shown in different operational positions. Since it is not believed to be necessary to illustrate or describe in detail the invention hereinafter claimed, only parts of the dispenser are shown to the extent necessary for full understanding of the invention.

For more complete understanding of a dispenser construction in which the invention herein may appropriately be incorporated, reference may be made, by way of example, to the Jespersen et al patent reissued July 20, 1976 under U.S. Pat. No. Re. 28,911 and DeLuca U.S. Pat. No. 4,188,844 issued Feb. 19, 1980. The disclosures of these patents may be considered as incorporated by reference herein.

In FIGS. 1 and 2 the dispenser 10 is shown having a chassis 12 suitably provided with means for affixing it in mounted position on a wall at a desired position accessible to the intended users. One or more rolls of flexible sheet material, like toweling, may be housed within the chassis 12. A single roll R having a spindle 14 received within the core C of roll R may have its ends slidably received in tracks 16 appropriately provided on inwardly facing walls of the chassis 12. It will be understood that the dispenser 10 shown in FIGS. 1 and 2 on the drawing has the cover (not shown) removed from dispenser chassis 12. As is characteristic of many sheet material dispensers, the combination of a chassis and associated cover complete a housing for the dispenser such that the roll or rolls of sheet material and mechanism for dispensing the web of material from each roll is essentially fully enclosed. The periphery of a handwheel that may be manually manipulated by the user to facilitate dispensing of the sheet material may be exposed exteriorly of the dispenser housing.

The roll R supported on spindle 14 carried by tracks 16 on chassis 12 is guided to move downwardly within dispenser 10 as a web W of sheet material is withdrawn from the roll and led out of the dispenser through elongated opening 18 near the lower end of dispenser chassis 12.

In the relation of parts shown on the drawing the web drawn off of the roll R passes over and around a feed roller 20 before leaving the dispenser through elongated opening 18. To promote guiding of the web from roll R relative to feed roller 20, a pinch roller (not shown) may be spring biased to press against the surface of roller 20 with the web of sheet material passing between the nip of these two rollers.

Although various forms of cutter mechanisms may be employed to divide the web coming from roll R into the individual sheets, the dispenser 10 illustrated on the drawing shows a cutting knife 22 mounted and carried within the feed roller 20. Knife 22 is mounted to project its cutting edge outwardly through an opening 24 in the peripheral surface of feed roller 20.

By way of example, the knife 22 may be mounted within feed roller 20 and be of a construction such as disclosed in the abovementioned DeLuca U.S. Pat. No. 4,188,844, issued Feb. 19, 1980. If the cutter mechanism employed is in accordance with this patent, the knife 22 will be cammed out and in relative to the periphery of feed roller 20 over which the web of material from roll R passes. This camming action creates movement of knife 22 in accordance with the rotational movements of feed roller 20. Of course, roller 20 is appropriately rotatably mounted on chassis 12 of dispenser 10, an appropriate mounting arrangement being suggested in the structure shown in this DeLuca Patent.

It of course is to be understood that the cutter mechanism employed in utilization of the invention of this application may take a variety of different forms other than the specific ones suggested in the above-identified DeLuca and Jespersen et al patents.

A manually engagable handwheel 26 is fixedly secured to one end of the feed roller 20 as by means of screw 28. Thus, handwheel 26 is mounted along with feed roller 20 so that the two parts are rotatable about a common axis on chassis 12. Importantly, in securing handwheel 26 to feed roll 20 the connection between these two parts is formed to a sure that the handwheel may only be positioned and secured to the end of feed roller 20 in one orientation between the two parts. A simple and effective means of securing this particular oriented relationship between the parts is best shown in the exploded view of FIG. 3. As will become apparent, it is important in the operational viability of the invention that the handwheel 26 and roller 20 be only attachable in this one oriented relationship.

The end of feed roller 20 may be provided with a square cavity 30 aligned with the rotational axis of roller 20. A keyway 32 is formed extending radially outwardly along one wall of cavity 30. At the rotational axis of handwheel 26 a square drive 34 is provided integral with handwheel 26 and centrally bored at 36 to receive therethrough the attaching screw 28. The bottom of cavity 30 has a threaded bore (not shown) to receive screw 28. The square drive 34 on handwheel 26 has a radially projecting rib 38.

In securing handwheel 26 to roller 20 in the required oriented relationship between the two, squared drive 34 and rib 38 are, respectively, received into cavity 30 and keyway 32. Then screw 28 is inserted and the two components are thereby fixedly secured together. Obviously, the handwheel 26 can only be attached to roller 20 in one oriented position between the two parts since the keyway 32 and rib 38 on the respective parts only allows the parts to be assembled in this required relationship.

The handwheel 26 is formed with finger engagable notches 40 peripherally spaced around the entire circumference of the handwheel. In the rotatably mounted position of feed roller 20 and handwheel 26 on chassis 12 of dispenser 10 a peripheral portion of handwheel 26 projects outwardly to an exposed position at the bottom of the dispenser 10. Even when the cover (not shown) of the dispenser is in place on chassis 12 this peripheral portion of handwheel 26 will be exposed for manual engagement by the fingers of a prospective user of the sheet material to effect forward rotation of feed wheel 20 and thus dispense the desired individual sheets of flexible material off of roll R and from the dispenser 10.

The notches 40 on the periphery of handwheel 26 have different configurations in first and second circumferential portions of the handwheel circumference. Generally described, the notches in the first circumferential portion are characterized by having a greater radial depth than do the notches disposed around the second circumferential portion of the handwheel. Although many different configurations to form appropriate finger engagable notches may be employed, in the illustrated embodiment the notches in the first circumferential of handwheel 26 are defined between radially extending elongated projections 42. However, the second circumferential portion on handwheel 26 has the notches 40 formed by rounded radial protuberances 44 lying on each side of the notch 40 in this portion of the handwheel 26 circumference.

It is to be noted that despite the different configurations of the notches 40 in different circumferential portions on the handwheel 26 periphery, there are manually engagable notches throughout the entire periphery of the handwheel 26. Thus in any rotative position of the handwheel and the feed roller 20 to which it is attached finger engagable notches 40 are exposed externally of dispenser 10 to enable manual forward rotation of handwheel 26 and feed roller 20 when dispensing of sheet material from roll R and dispenser 10 is desired.

The feed roller 20 to which handwheel 26 is attached is driven through a portion of each revolution by an over-center means including a spring 50 connected to the chassis 12 by a fastener 52. The other end of spring 50 is connected to handwheel 26 by a screw 54 through link 56. Screw 54 is attached off-center from the rotational axis of handwheel 26 and feed roller 20. It will be readily understood that during rotation of handwheel 26 and feed roller 20, in the direction shown by the arrows on FIGS. 1 and 2, the spring 50 is tensioned as handwheel 26 is rotated from the position shown in FIG. 1 to the position where screw 54 on handwheel 26 is diametrically opposite this position.

When the screw 54 passes beyond this diametrically opposite position from that shown in FIG. 1 and beyond the position where the axis of link 56 intersects the rotational axis of handwheel 26 and roller 20, spring 50 expends its stored energy to assist in further rotation of handwheel 26 and feed roller 20. Where a cutter mechanism including a knife 22 within feed roller 20 is employed, such as suggested in DeLuca U.S. Pat. No. 4,188,844, the stored energy of spring 50 in assisting further rotation of handwheel 26 and feed roller 20 serves to activate knife 22 so that the web being withdrawn from roll R and dispenser 10 is severed and additional flexible sheet material is fed into position for accessibility to the user for the next use of the dispenser 10.

Withdrawal of web W, in the form of divided material sheets, involves forward rotation of feed roller 20. It is not desired that the feed roller be free for any extended reverse rotation. Extended rotation in a reverse direction i.e., opposite to that shown by the arrows on FIGS. 1 and 2 on the drawing, could result in the leading end of the web being withdrawn from roll R becoming unthreaded within the dispenser 10. In such event, sheet material would not be accessible to a subsequent user of the dispenser and the services of an attendant to remove the dispenser cover and thereupon rethread the web from roll R within the dispenser could be necessary.

An anti-rotation device is provided to cooperate with the notches 40 on handwheel 26. This device has a pawl 60 pivotally mounted on pin 62 screwed into the side wall of chassis 12. The end of pawl 60 remote from pin 62 carries a tooth 64. Pawl 60 is free to pivot on pin 62 such that its tooth 64 will successively engage in the notches 40 on the periphery of handwheel 26. Pawl 60 and pin 62 are so positioned that the pawl falls by gravity into the notches 40 in succession as the handwheel 26 is rotated counter-clockwise. Incident this rotation in the direction of the arrows on FIGS. 1 and 2, the radially extending projections 42 and protuberances 44 serve to raise pawl 60 and thus permit free counter-clockwise turning of the handwheel 26 with feed roller 20 attached thereto. But, the projections 42 engage tooth 64 of pawl 60 to effectively prevent reverse rotation of handwheel 26 and feed roller 20.

Reverse or clockwise rotation of handwheel 26 is prevented whenever pawl 60 is engaged within one of the relatively deep notches 40 formed between the radially extending elongated projections 42, such notches being spaced around the circumference of the handwheel in the first circumferential portion. However, when handwheel 26 is rotated to a position where the notches 40 lying on each side of a rounded radial protuberance 44 are engaged by pawl 60, the tooth 64 of the pawl will be ineffective to prevent reverse rotation of hand wheel 26. Thus, in the second circumferential portion of the handwheel periphery where the rounded radial protuberances 44 lie, reverse rotation will not be prevented by the action of pawl 60 and its tooth 64 engaging the handwheel periphery.

It may be noted that in the embodiment illustrated, the second circumferential portion of the handwheel periphery where the rounded radial protuberances 44 are disposed occupies generally a quadrant of the handwheel periphery. When this quadrant of the periphery is passing beneath the tooth 64 of pawl 60, the handwheel 26 may rotate in a reverse direction or clockwise as shown on FIGS. 1 and 2 with tooth 64 merely sliding or riding over the smoothly rounded radial protuberances 44 disposed in this quadrant of the handwheel periphery.

The particular oriented position of handwheel 26 relative to feed roller 20 is important to properly locate the quadrant with the low profile rounded radial protuberances 44 relative to the position of knife 22 on feed roller 20. Accordingly, the keyed connection between the feed roller 20 and handwheel 26 as shown in FIG. 3 is important since handwheel 26 can only be affixed in one oriented position relative to feed roller 20.

An important feature of this invention is to ensure that the cutting mechanism, in the illustrated embodiment knife 22 within feed roller 20, be returned to a safe protected position within the dispenser chassis 12. Thus, when an attendant removes the dispenser cover (not shown) from chassis 12 as to repair, reload or rethread sheet material, the cutter mechanism including knife 22 in the illustrated embodiment, will be in this safe protected position and not be accessible to endanger or injure the attendant. Thus the second circumferential notched portion on the perimeter of handwheel 26 is disposed such that when the handwheel is rotated from the position shown in FIG. 1 and while the spring 50 is having energy stored therein by movement of screw 54 down to its lowermost position, the anti-reversing device formed by pawl 60 should not be effective at a point where the knife 22 would be exposed outwardly of the dispenser upon the cover's removal. As the low profile protuberances 44 move beneath the pawl 60, if the handwheel 26 is released, the energy stored in spring 50 will act through link 56 and screw 54 to cause reverse rotation of handwheel 26 and consequent reverse rotation of feed roller 20 to move knife 22 back into an unexposed protected position. However, when the handwheel 26 is rotated beyond the position where screw 54 passes beneath the screw 28 the spring 50 will tend to assist in the cutting action relative to the web removed from roll R. It will also effectively return the knife 22 on feed roller 20 around beneath the lower end of the roller and into a safe protected position interiorally of the dispenser chassis 12.

It should be clear from the illustrated relationship between the second circumferential portion, where the low profile protuberances 44 are disposed, and the location of knife 22 and opening 24 on feed roller 20 where ineffectiveness of anit-reversing pawl 60 will occur incident each revolution of handwheel 26. However, the notches 40 around the entire periphery of the handwheel 20 still enable the user to manually actuate the handwheel, if necessary to dispense the web W in the form of individual sheets from the dispenser. Still, the low level profile formed by the rounded radial protuberances 44 in the second circumferential proportion on the handwheel renders the anti-reversing device of pawl 60 and its tooth 64 ineffective throughout the desired portion of each handwheel revolution. But, the effect of the overcenter spring 50 and link 56 acting through eccentrically connected screw 54 on handwheel 26 performs its desired function to assist in dispensing the web of material and additionally, under the instant invention, performs the desired action of reversing rotation of handwheel 26 and feed roller 20 if the handwheel and feed roller are released at a position where upon removal of the cover (not shown) the cutting mechanism would be exposed to an attendant required to reload the dispenser 10.

The foregoing sets forth a detailed description of the sheet material dispenser with its adventageous features to promote safety against injury to an attendant servicing the dispenser that could occur by reason of the cutting mechanism being exposed when the dispenser cover is removed. Clearly the peripheral extent and location of the two differently configured notched portions on the perimeter of handwheel 26 and location or construction of the anti-reversing device shown being formed by pawl 60 may be altered, all within the contemplated scope of the invention disclosed herein. Thus, it is recognized that various modifications of the dispenser, the cutting mechanism and other structural features of the invention may occur to those skilled in the art. Therefore the scope of the invention is to be limited solely by the scope of the hereinafter appended claims.

I claim:

1. A dispenser for sheet material comprising:

a wall mountable chassis having means for supporting a roll of flexible sheet material;

a rotatably mounted feed roller on said chassis to guide a web of material from the roll to be grasped by the user;

cutter mechanism operated by rotation of said roller to divide the web into individual sheets;

a manually engagable handwheel mounted to rotate with said feed roller;

finger engagable notches peripherally spaced around the circumference of said handwheel to facilitate manual forward rotation thereof;

means to prevent reverse rotation of said handwheel through a first circumferential portion of each handwheel revolution; and biasing means connected to urge rotation of said feed roller toward a predetermined rotational position and cause reverse rotation through a second circumferential portion of handwheel revolution so as to move said cutter mechanism to a protected location within said dispenser when said handwheel is free from manual restraint.

2. A dispenser for sheet material as recited in claim 1 wherein said notches have different configurations in said first and second circumferential portions of said handwheel and said means to prevent reverse rotation cooperates with said notches through each handwheel revolution.

3. A dispenser for sheet material as recited in claim 2 wherein said means to prevent reverse rotation includes pawl means mounted on said chassis to successively engage in said notches.

4. A dispenser for sheet material as recited in any of claims 1, 2 or 3 wherein said notches around said first circumferential portion are characterized by being of a greater radial depth than said notches around said second circumferential portion of said handwheel such that said means to prevent reverse rotation is ineffective to prevent reverse rotation when cooperating with the notches of said second circumferential portion.

5. A dispenser for sheet material as recited in claim 4 wherein said notches in said first circumferential portion are each defined between radially extending elongated projections and a rounded radial protuberance lies between adjacent notches in said second circumferential portion.

6. A dispenser for sheet material as recited in any of claims 1, 2, or 3 wherein said biasing means includes a spring connected between said chassis and a point on said handwheel radially spaced from the axis of rotation of said handwheel, said feed roller and said handwheel are secured together to rotate on a common axis, said notches around said second circumferential portion include generally a quadrant of the handwheel periphery, and said cutter mechanism includes a cutting edge carried by said feed roller disposed at a position to divide the web in an area that is located within said quadrant.

7. A dispenser for sheet material as recited in claim 6 wherein said first circumferential portion notches are characterized by being of a greater radial depth than said second circumferential portion notches such that said mean to prevent reverse rotation is ineffective to prevent reverse rotation when cooperating with the notches of said second circumferential portion.

* * * * *